US005331609A

United States Patent [19]

Gubin

[11] Patent Number: 5,331,609

[45] Date of Patent: Jul. 19, 1994

[54] CLOCK APPARATUS

[76] Inventor: Alexander N. Gubin, 5505 Halpine Pl. #101, Rockville, Md. 20851

[21] Appl. No.: 130,685

[22] Filed: Oct. 4, 1993

[51] Int. Cl.[5] ..... G04B 19/24

[52] U.S. Cl. ..... 368/223; 368/40

[58] Field of Search ..... 368/76, 235, 223, 156, 368/159

[56] References Cited

U.S. PATENT DOCUMENTS 3,956,879 5/1976 Bailey ..... 368/76
4,022,015 5/1977 Bailey ..... 368/40
4,752,919 6/1988 Clark ..... 368/223

*Primary Examiner*—Bernard Roskoski
*Attorney, Agent, or Firm*—E. Michael Combs

[57] ABSTRACT

A clock housing is arranged to include a front wall having a window directed therethrough, within the clock housing is arranged adjacent first and second endless belts having first and second respective self-reversing step motors arranged to direct opaque portions of the respective first and second belts along the window for indication of respective hours and minutes, with the belts reversing to present respective second colorations of the respective first and second belts upon reversing of the step motors.

1 Claim, 4 Drawing Sheets

CLOCK APPARATUS

BACKGROUND OF THE INVENTION

1. Field of the Invention

The field of invention relates to clock apparatus, and more particularly pertains to a new and improved clock apparatus wherein the same is arranged to indicate hours and minutes employing endless belts to simulate bar graph type simulation.

2. Description of the Prior Art

Clock apparatus of various types are indicated in the prior art such as indicated in the U.S. Pat. Nos. 4,026,102; 4,847,785; 5,105,396; and 4,739,319.

The instant invention attempts to address deficiencies of the prior art by providing for a structure arranged for ease of construction as well as use, wherein preprogrammed self-reversing step motors are arranged to direct opaque portions of a belt in adjacency to a transparent window, wherein opposed sides of the windows are arranged in gradations to indicate respective hours and minutes relative to a calendar day.

SUMMARY OF THE INVENTION

In view of the foregoing disadvantages inherent in the known types of clock apparatus now present in the prior art, the present invention provides a clock apparatus wherein the same Includes endless belts to present opaque portions of the belts as representative of time passage. As such, the general purpose of the present invention, which will be described subsequently in greater detail, is to provide a new and improved clock apparatus which has all the advantages of the prior art clock apparatus and none of the disadvantages.

To attain this, the present invention provides a clock housing arranged to include a front wall having a window directed therethrough, within the clock housing is arranged adjacent first and second endless belts having first and second respective self-reversing step motors arranged to direct opaque portions of the respective first and second belts along the window for indication of respective hours and minutes, with the belts reversing to present respective second colorations of the respective first and second belts upon reversing of the step motors.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved clock apparatus which has all the advantages of the prior art clock apparatus and none of the disadvantages.

It is another object of the present invention to provide a new and improved clock apparatus which may be easily and efficiently manufactured and marketed.

It is a further object of the present invention to provide a new and improved clock apparatus which is of a durable and reliable construction.

An even further object of the present invention is to provide a new and improved clock apparatus which is susceptible of a low cost of manufacture with regard to both materials and labor, and which accordingly is then susceptible of low prices of sale to the consuming public, thereby making such clock apparatus economically available to the buying public.

Still yet another object of the present invention is to provide a new and improved clock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
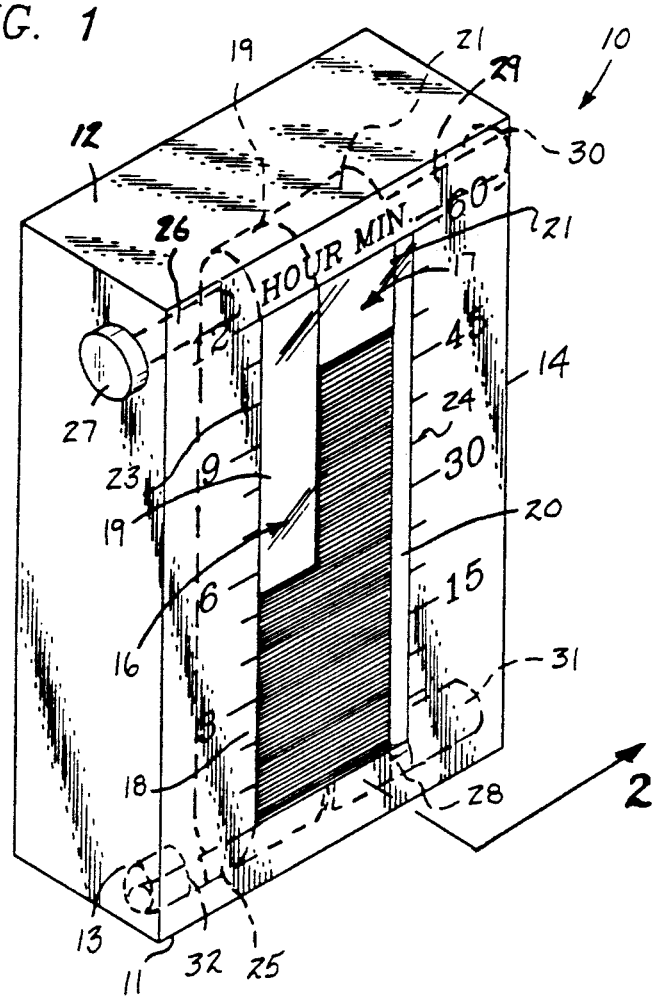
FIG. 1 is an isometric illustration of the invention.
Figure 2:
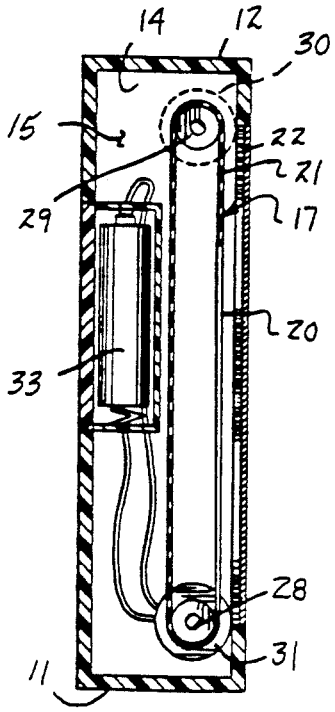
FIG. 2 is an orthographic view, taken along the section line 2 of FIG. 1.
Figure 3:
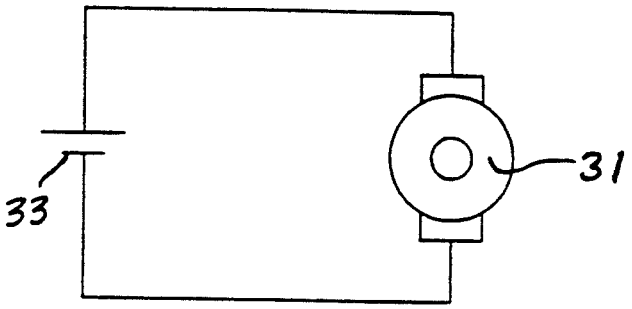
FIG. 3 is a diagrammatic illustration of the battery in association with an individual self-reversing step motor.

With reference now to the drawings, and in particular to FIGS. 1 to 7 thereof, a new and improved clock apparatus embodying the principles and concepts of the present invention and generally designated by the reference numeral 10 will be described.

More specifically, the clock apparatus 10 of the instant invention essentially comprises a housing having a bottom wall 11 spaced from a top wall 12, a first side wall 13 spaced from a second side wall 14, as well as a front wall having a front wall transparent window directed therethrough, with the transparent window 22 of a predetermined width to span a first endless belt 16 and a second endless belt 17 that are movably mounted along the window. The first belt 16 has a first belt first coloration portion 18 and a first belt second coloration portion 19, with the first coloration darker than the second coloration and the first coloration opaque and the second coloration transparent, and within a like manner the second belt 17 has a second belt first coloration 20 and a second belt second coloration 21. First gradations are 23 directed from zero through 12 and arranged to indicate hours along the first belt, while second gradations 24 directed from zero to sixty are arranged to indicate minutes in adjacency to the second belt along a second side of the window 22. The first belt includes a first axle 25 in operative communication with a first belt self-reversing step motor 32, while the second belt includes a second belt first axle 28 in operative communication with a second belt self-reversing step motor 31. A first belt second axle 26 is arranged parallel to the first belt first axle 25 terminating in a first dial 27 projecting beyond the first side wall 13. A second belt second axle 29 parallel to the second belt first axle 28 terminates in a second dial 30 projecting beyond the second side wall 14. A battery member 33 mounted within the cavity 15 is arranged to direct electrical energy to the first and second self-reversing step motors 31 and 32 respectively. The step motors are arranged such that the first step motor 32 directs the first belt first coloration 18 coextensively along the window 18 within twelve hours and incrementally steps the first coloration of the first belt, whereupon subsequent to a twelve hour cycle, the first step motor reverses to provide for only the first belt second coloration 19 to be positioned in adjacency to the transparent window. In a similar manner, the second self-reversing step motor 31 in incremental sixty minute gradations directs the second belt first coloration 20 along the transparent window until the entire window and more specifically along the scale 24 completes the sixty minute cycle, whereupon the second belt self-reversing step motor 31 reverses itself to only indicate the second belt second coloration 21 in adjacency to the window.

Figure 4:
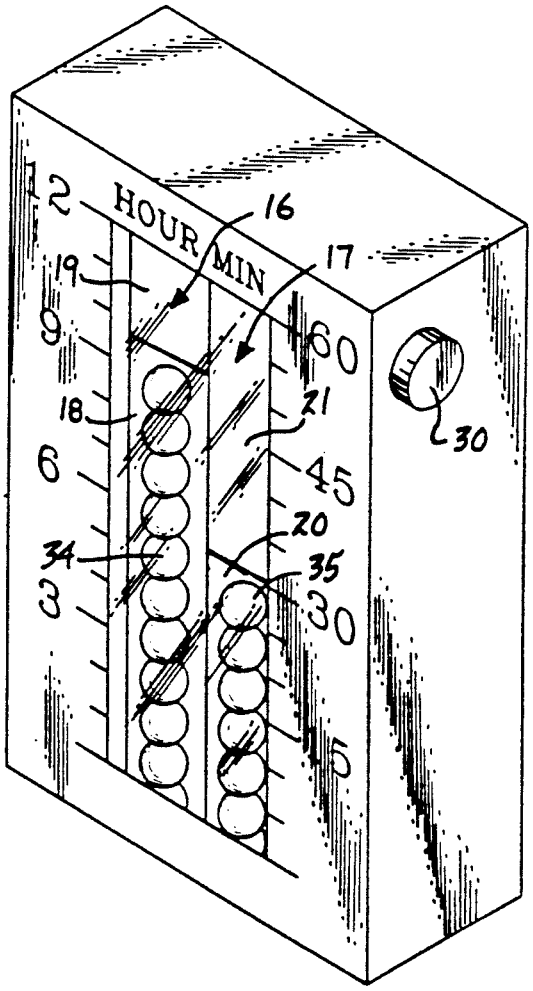
FIG. 4 is an isometric illustration of the invention employing chemiluminescent members along the opaque portions of the belts.
Figure 5:
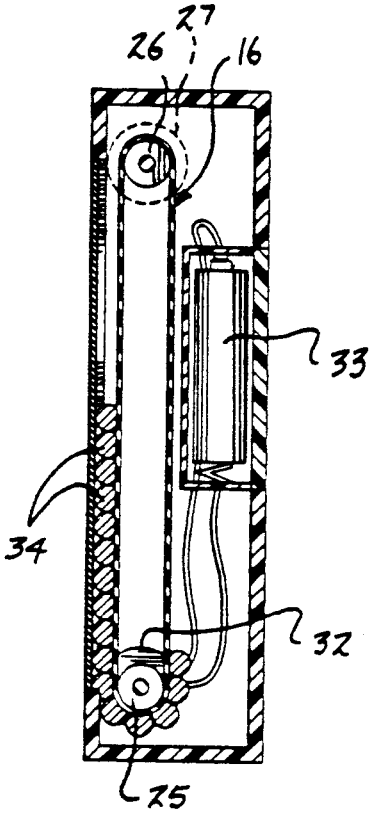
FIG. 5 is an orthographic cross-sectional illustration indicating the chemiluminescent spheres mounted to the belt structure.

Additionally to enhance visual observation of the first and second belts' first colorations, respective first and second rows of chemiluminescent spheres 34 and 35 respectively are mounted coextensively along the first and second belts' first coloration portions, in a manner as indicated in FIG. 4, for enhanced illumination during use of the clock apparatus in conditions of limited available light.

Figure 6:
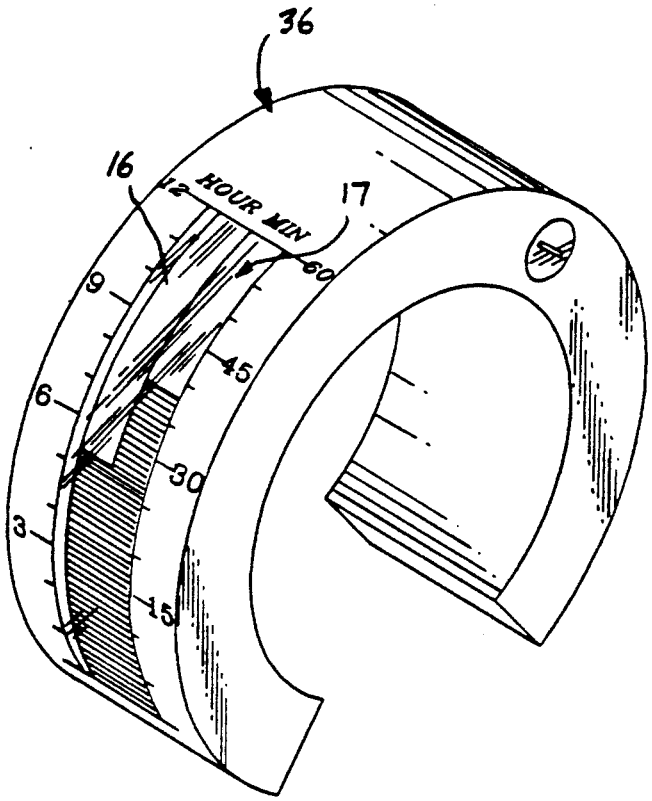
FIG. 6 is an isometric illustration of the invention arranged in a semi-cylindrical configuration.
Figure 7:
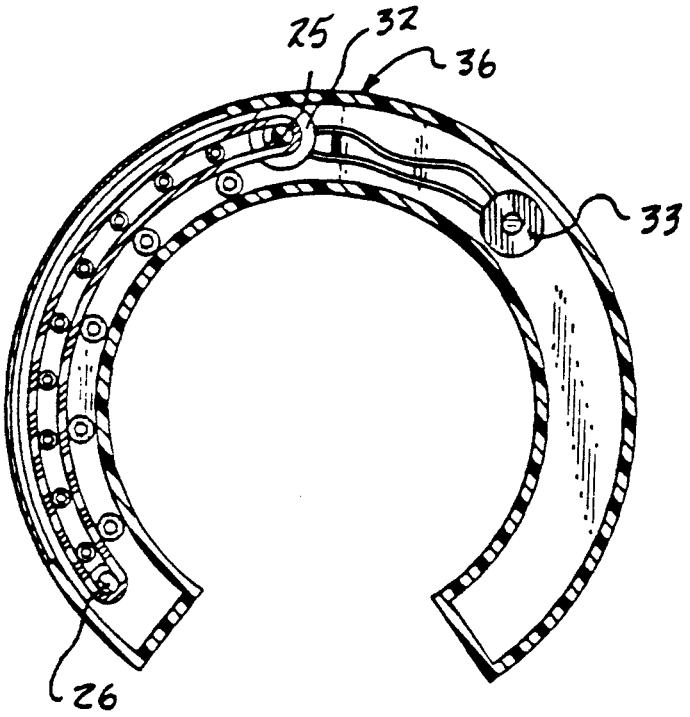
FIG. 7 is an orthographic cross-sectional illustration of the semi-spherical configuration of the housing as indicated in FIG. 6.

The FIG. 6 indicates the housing formed as a semi-cylindrical bracelet housing 36 for use by individuals.

It should be further understood for example that access to the battery 33 is availed through various access doors as required for access to the housing cavity 15 to permit replenishment and servicing of the battery 33 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are Intended to be encompassed by the present invention.

Therefore, the foregoing is considered as illustrative only of the principles of the invention, Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clock apparatus, comprising, a housing having a housing bottom wall spaced from a housing top wall, a housing first side wall spaced from a housing second side wall, and a housing front wall and housing rear wall, with a cavity oriented within the housing, and the front wall having a transparent window directed through the front wall, and a first endless belt mounted within the cavity, and a second endless belt mounted within the cavity, with the first endless belt and the second endless belt arranged in adjacency relative to one another, with the first endless belt and the second endless belt positioned in adjacency to the window, with the window spanning the first endless belt and the second endless belt, the first belt having a first belt first coloration and a first belt second coloration, the second endless belt having a second belt first coloration and a second belt second coloration, with the first belt first coloration darker than said first belt second coloration, and the second belt first coloration darker than said second belt second coloration, with first gradations positioned on the housing front wall to a first side of the window in adjacency to the first belt, and second gradations directed along the window in the front wall in adjacency to the second belt, with the first drive means mounted within the cavity and in operative communication with the first belt to direct the first belt first coloration along the window in a twelve hour cycle, and further drive means in operative communication with the second belt to direct the second belt first coloration along the window in a sixty minute cycle, and the drive means includes a first belt self-reversing step motor, and the further drive means includes a second belt self-reversing step motor, with the first belt self-reversing step motor including a first belt first axle mounting the first belt at a first belt first end, whereupon subsequent to a twelve hour cycle, the first step motor reverses to provide for only the first belt second coloration to be positioned adjacent the transparent window, and the second belt self-reversing step motor including a second belt first axle mounting the second belt at a second belt first end, whereupon the completion of a sixty minute cycle, the second self reversing motor reverses itself to only indicate the second belt second coloration adjacent the window, with the first belt having a first belt second axle parallel to said first belt second axle, with the first belt first axle projecting through the housing first side wall, and the second belt having a second belt second end, with the second belt second end including a second belt second axle, with the second belt second axle projecting through the housing second side wall, and the first belt first coloration includes a first row of chemiluminescent members, and the second belt first coloration includes a second row of chemiluminescent members directed therealong.

* * * * *